US005080371A

United States Patent [19]

Karczewski

[11] Patent Number: 5,080,371

[45] Date of Patent: Jan. 14, 1992

[54] FOOT ATTACHABLE APPARATUS FOR TOSSING AND RECEIVING A BALL

[76] Inventor: Robert A. Karczewski, P.O. Box 403, Hyannis, Mass. 02601

[21] Appl. No.: 683,776

[22] Filed: Apr. 11, 1991

[51] Int. Cl.[5] ..... A63B 59/00

[52] U.S. Cl. ..... 273/323; 2/22; 273/67 B; 273/DIG. 18

[58] Field of Search ..... 273/323, 67 B, DIG. 18; 2/22

[56] References Cited

U.S. PATENT DOCUMENTS

| | | | |
|---|---|---|---|
| 1,637,278 | 8/1927 | Renz | 273/DIG. 18 |
| 2,220,291 | 11/1940 | Savoy | 273/67 B X |
| 2,269,357 | 1/1942 | Dent | 273/67 B |
| 2,930,618 | 3/1960 | Glintz | 273/323 |
| 3,169,019 | 2/1965 | Genjack | 273/323 X |
| 3,610,622 | 10/1971 | Harouski | 273/312 X |
| 3,628,794 | 12/1971 | Conture | 273/DIG. 18 X |
| 4,302,017 | 11/1981 | Huqueriza | 273/323 |
| 4,718,676 | 1/1988 | Collins | 273/323 X |
| 4,769,854 | 9/1988 | Williams | 2/22 |

FOREIGN PATENT DOCUMENTS

| | | | |
|---|---|---|---|
| 3334142 | 4/1985 | Fed. Rep. of Germany | 273/323 |
| 1238985 | 6/1960 | France | 273/323 |

*Primary Examiner*—William H. Grieb

*Attorney, Agent, or Firm*—Cesari and McKenna

[57] ABSTRACT

A foot attachable game apparatus which enables a player to both toss and receive a game ball. The apparatus is generally trough shaped with an interior lining which cushions the reception of a game ball within the apparatus. The apparatus has at least two retaining means to help hold a game ball in the apparatus. The apparatus has a scoop which provides the player with control over the ball for passes and shots and enables the player to scoop up a loose game ball. A recess in the lining, allows the player to cradle the ball in the recess thus giving the player greater control over the ball.

11 Claims, 1 Drawing Sheet

FOOT ATTACHABLE APPARATUS FOR TOSSING AND RECEIVING A BALL

FIELD OF THE INVENTION

This invention relates generally to a foot attachable game apparatus and more specifically to a foot attachable game apparatus which improves physical fitness and coordination.

BACKGROUND OF THE INVENTION

Games and sporting activities which require physical skills and manual dexterity continue to have widespread appeal. They provide an enjoyable diversion from everyday activities and have often enticed individuals who otherwise would not exercise to become more physically active. Despite this continued interest, there is a noticeable lack of appealing games and sporting activities, particularly those which improve physical fitness and foot-to-eye coordination.

The development and maintenance of good physical fitness and coordination is important, particularly among children. Most games and sporting activities help improve physical fitness and hand-to-eye coordination, but few help improve foot-to-eye coordination. The few activities that do develop foot-to-eye coordination, are primitive in their design, involve only one player, and are generally unappealing. Despite the potential benefits these few activities may provide, neither children nor adults want to participate in these boring activities.

Disinterest in a game or sporting activity is often attributable to the difficulty of the game or activity. Games and sporting activities are often either too difficult to learn or too easy to master. Either case is undesirable because individuals quickly lose their interest in them. Games and sporting activities which will captivate both a beginner's and an expert's interest are needed.

SUMMARY OF THE INVENTION

This invention relates to a game apparatus which is designed to provide a pleasurable means of outdoor and indoor activity which will improve physical fitness and foot-to-eye coordination. The apparatus may also be used as part of a physical therapy program for improving motor skills. The basics of the game are fairly simple to learn, but the game requires continued practice to master.

The foot attachable game apparatus includes a trough shaped housing, formed by a first wall, with one end of the housing sealed by a second wall and the other end extending into a scoop. A retaining wall partially closes off the trough shaped housing near the second wall. Rims of the first wall forming the trough shaped housing, a rim of the retaining wall, and a rim of the scoop define an opening which is large enough to allow a game ball to enter the trough shaped housing. The apparatus attaches to the bridge of a player's foot just over his/her toes and generally rests in a horizontal orientation with the foot at rest on the ground.

The interior of the trough shaped housing may have a first and second lining for cushioning the reception of a hard game ball within the housing. The linings help reduce the chance of a game ball bouncing out upon impact with the interior of the housing. An optional gap between the second wall and the second lining provides a space for the second lining to expand, further cushioning the reception of a game ball. The lining may not be necessary, if a relatively spongy game ball is used.

If the housing has linings, then the first lining may have a recess of a sufficient size to cradle a game ball. The recess is usually located near the scoop and allows the player to cradle the ball for greater control for passes and shots.

The retaining wall, near the second wall, helps the player retain a received game ball within the housing. A game ball, upon entering the housing, may have a tendency due to its momentum to bounce in a generally latitudinal direction relative to the housing. The retaining wall helps to force the ball back into the housing.

The scoop located at the opposite end of the trough from the second wall has several functions. It helps to retain the ball within the housing, it helps the player pass and shoot the ball, and it enables the player to scoop a ball off the playing surface using only the apparatus. The player does not need to use his hands to be capable of placing the ball within the housing.

The game apparatus can be used by a single player or by multiple players. The game apparatus allows players to shoot the game ball at a target or to pass a game ball between themselves. One suggested activity using the apparatus is a game similar to lacrosse. The players form two teams. Each team has a goalie equipped with a lacrosse goalie stick. The players on each team are restricted to play in certain zones on the playing surface. The object of the game is to advance the game ball up field by passing the game ball between players on the same team, using the foot apparatus, and eventually to shoot the ball past the goalie into the net for a goal.

It is therefore an object of the present invention to provide a game apparatus which can be used to improve foot-to-eye coordination.

Another object of the invention is to provide a game apparatus which will have widespread appeal among adults and children.

Another object of the invention is to provide a game apparatus which can be enjoyed by both a novice and an expert.

Another object of the invention to provide a game apparatus which can be used by multiple players to toss and receive a game ball.

Another object of the invention to provide a game apparatus which is attached to the player's foot which enables the player to scoop the game ball off the playing surface using only the apparatus.

Another object of the invention to provide a game apparatus which may be used in a physical therapy program to improve motor skills.

BRIEF DESCRIPTION OF THE DRAWINGS

For a fuller understanding of the nature and objects of the invention, reference should be had to the following detailed description taken in conjunction with the accompanying drawings in which.

DESCRIPTION OF THE PREFERRED EMBODIMENT

Figure 1:
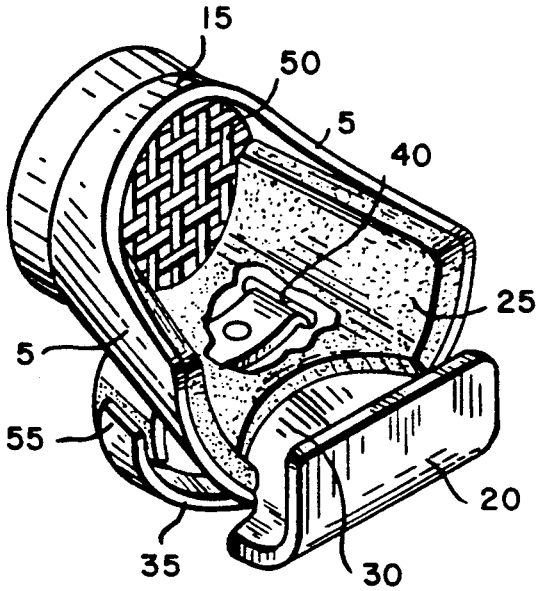
FIG. 1 is an isometric view of the foot attachable game apparatus.

FIG. 1 illustrates one embodiment of the foot attachable game apparatus which generally has a trough shape. The apparatus has a first wall 5 which defines a trough shaped housing capable of receiving a game ball. A second wall 10 seals one end of the trough shaped housing. A scoop means 20 extends out from the end of the housing opposite the second wall 10. The cross sectional area of the trough shaped housing defined by the first wall 5 may be uniform throughout or the cross sectional area of the trough shaped housing near the scoop means 20 may be larger tapering to a smaller cross sectional area near the second wall 10. The latter configuration for the trough shaped housing increases the area near the scoop means 20 making the reception of a game ball easier because of a larger reception area. Typically, the trough shaped housing will be approximately 5 inches long and the housing will have a cross sectional diameter of approximately 4 inches near the second wall 10 and a cross sectional diameter of approximately 4.5 inches near the scoop means. The sides of the trough shaped housing formed by first wall 5 will typically be high to help retain a game ball within the housing once received, but sufficiently distant from each other to allow a game ball to enter the interior of the trough shaped housing.

A retaining means 15 extends at least partially over the open portion of the trough shaped housing near the second wall 10. The retaining means 15 is connected to at least one rim of the first wall 5 near second wall 10. The retaining means 15 extends a sufficient distance out from the second wall 10 to reduce the chance of the game ball 45 escaping from the housing. Typically, the retaining means 15 will extend approximately 2 inches out from the second wall 10 into the interior of the trough shaped housing. The retaining means 15 may be a single post or a number of posts extending partially or completely over the open portion of the trough shaped housing, a wire or wires extending over the housing, or as shown, a wall extending over the housing and connecting the first and second walls 5 and 10.

The end of the trough shaped housing, opposite from the second wall 10, extends into a scoop means 20. The scoop means 20 may be manufactured as an integral part of the housing or may be attached to the housing at a later time. The scoop means 20 is angled inwardly in the general direction of the retaining means 15. Typically, the scoop means 20 will extend approximately 1.5 inches out from the trough shaped housing and then an additional 1.5 inches up, angled slightly inwardly towards the retaining means 15. The scoop means 20 helps retain the game ball 45 in the housing, thus reducing the chance of the ball 45 escaping in a generally longitudinal direction when the apparatus is resting on the player's foot in a generally horizontal orientation. The scoop means 20 also enables the player to exhibit some control over the ball 45 for passes and shots and enables the player to scoop the game ball 45 off the playing surface.

Figure 3:
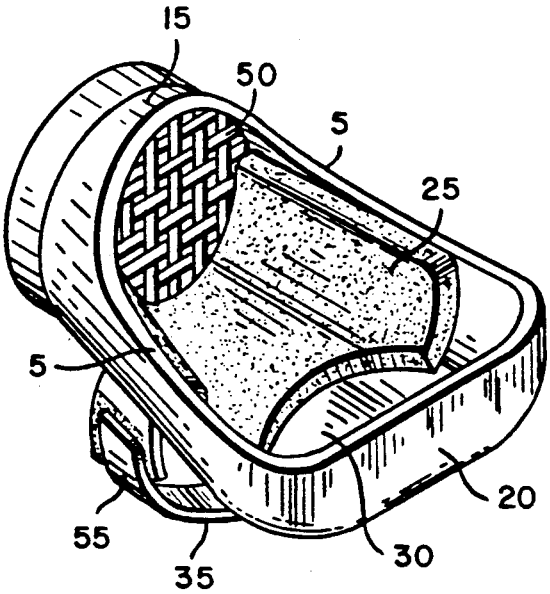
FIG. 3 is an isometric view of another embodiment of the foot attachable game apparatus.

First and second cushioning means 25 and 50 cushion the landing of the game ball 45 in the trough shaped housing, thus reducing the chance that the game ball 45 will bounce out of the housing from impact. The first cushioning means 25 may partially or fully line the first wall 5 in the interior of the housing. The first cushioning means 25 may comprise a relatively non-resilient foam pad and will typically be about 0.75 inches thick. The second cushioning means 50 may connect the retaining means 15 with the interior of the trough shaped housing formed by first wall 10. The second cushioning means 50 may cover second wall 10 or may be located away from second wall 10 in the interior of the housing. In the latter position, the second cushioning means 50 should be closer to the second wall 10 than the rim of the retaining means 15. If the second cushioning means 20 is not resting on the second wall !0 then there will be a gap 12 between the second wall 10 and the second cushioning means 50, see FIG. 2. The gap 12 provides a space for the second cushioning means 20 to expand when struck by a game ball. This further reduces the chances of the game ball bouncing out upon impact with the apparatus and makes reception of the ball much easier. The second cushioning means 50 may comprise a netting or mesh material. The tension in the netting or mesh material may be adjusted for the type of game ball used. Typically, with a retaining means 15 extending 2 inches away from second wall 10 the second cushioning means will be located approximately 1.25 inches away from the second wall 10 inside the trough shaped housing. Although FIGS. 1 and 3 show two distinct cushioning means, the first and second cushioning means 25 and 50 could also be made as one integral cushioning means 27, as seen in FIG. 2.

If a cushioning means is used, then a recess 30 may also be formed in the first cushioning means 25, preferably near the scoop means 20. The recess 30 is preferably of a sufficient size to be capable of cradling a game ball 45 in the apparatus. Typically, the recess 30 will be a half circle configuration at the edge of the trough shaped housing near the scoop means 20 with a radius of approximately 1.5 inches. Usually, when the ball 45 is in recess 30, the ball 45 would also be resting against scoop means 20. The ability to cradle the ball 45 enables the player to exhibit greater control over the ball 45 for passes and shots. The recess 30 may extend part way or all of the way through the first cushioning means 25 to first wall 5.

The apparatus may be attached to the bridge of the player's foot by an adjustable strap 35 with hook and loop fastening strips 55. The strap 35 can be secured to the apparatus in a number of ways. In FIGS. 1 and 3, the strap 35 passes through two slots 40 in the first wall 5, thus securing the strap to the housing. If the strap 35 is secured to the housing by passing through slots 40, the strap 35 may be hidden from view by first cushioning means 25 which may be placed over the strap 35. The slots 40 in the first wall 5 may extend through first cushioning means 25 thus making the strap 35 visible. The strap 35 may also be secured to the housing with rivets. Typically, the adjustable strap will be approximately 1 inch wide and approximately 12 inches long. The apparatus may also be attached to a flexible shoe or shoe covering 37 which fits over a player's foot.

Figure 2:
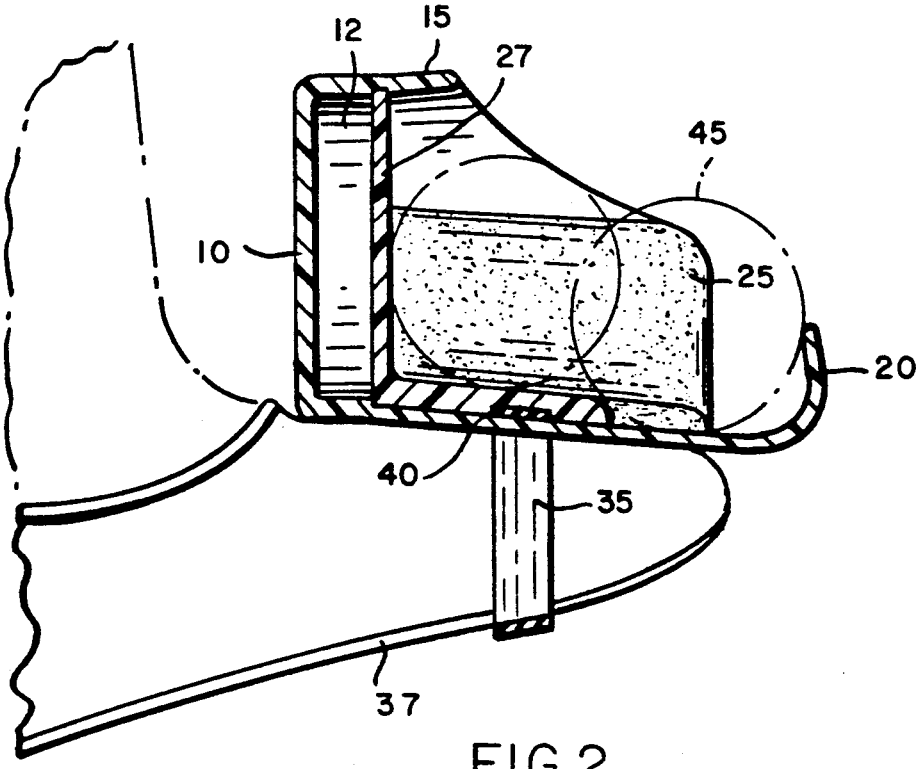
FIG. 2 is a cut-away view of the foot attachable game apparatus attached to a player's foot.

FIG. 2 discloses a side view of the game apparatus attached to a player's foot. The figure shows the second wall 10, the gap 12, the retaining means 15, the scoop means 20, the strap 35, the slot 40, the game ball 45, and the second cushioning means 50. In this cut-away view, the location of the ball 45 can be observed in different parts of the housing. Near the front of the housing, the ball 45 has descended into the recess 30 of first cushioning means 25 and the ball 45 is resting on the first wall 5 and against scoop means 20. Positioning the ball 45 in the recess 30 gives the player greater control over the ball 45 for passes and shots. When the ball 45 is near the second wall 10, the ball 45 is supported by first cushioning means 25. If there is no cushioning means, then the ball 45 rests directly on the first wall 5 which forms the trough shaped housing. In FIG. 2, the second cushioning means 50 is not covering the second wall 10, but instead is connecting the retaining means 15 with the interior of the trough shaped housing formed by first wall 5 away from second wall 10. The gap 12 between the second cushioning means 50 and the second wall 10 gives the second cushioning means 50 additional room to expand when struck by the game ball 45. The gap 12 makes the second cushioning means 50 even more effective in keeping a game ball within the housing when received. The retaining means 15 extends out beyond the connection between the retaining means 15 and second cushioning means 50. This extension prevents the game ball from bouncing out in a latitudinal direction when the housing is resting in a longitudinal direction.

FIG. 3 is an isometric view of another embodiment of the foot attachable game apparatus. In FIG. 3, the first wall 5 and scoop means 20 are formed as one integral unit. The scoop means 20 is still angled inwards in the general direction of the retaining means 15. The remaining elements are the same as described in FIG. 1.

It should be understood that the foregoing description is intended to illustrate rather than limit the invention. Modifications and additions to the disclosed embodiments will be recognized by those skilled in the art which do not depart from the scope of the invention, as defined by the appended claims.

I claim:

1. A foot-attachable game apparatus for tossing and receiving a game ball, said apparatus comprising an elongated housing having a longitudinal axis, the housing including a first wall which extends along and partially around the axis to define a trough and a second wall closing one end of the trough, the opposite end of the trough being open;

a ball retaining means connected to the trough defined by the first wall near the second wall, for retaining a game ball in the trough;

a scoop means extending from the opposite end of the trough and overhanging the opposite end of the trough for scooping up a game ball and retaining it in the housing; and a means for releasably securing the housing to a human foot so that the axis is generally parallel to the foot.

2. A foot-attachable game apparatus for tossing and receiving a game ball as in claim 1 wherein the securing means comprises a strap with hook and loop fastening strips, and a means for securing the strap to the first wall of the housing.

3. A foot-attachable game apparatus for tossing and receiving a game ball as in claim 1 wherein the securing means comprises a flexible shoe attached to the apparatus.

4. A foot-attachable game apparatus for tossing and receiving a game ball as in claim 1 wherein the scoop means comprises a flexible resilient curved blade.

5. A foot-attachable game apparatus for tossing and receiving a game ball as in claim 4 wherein the distance between the blade rim and the retaining means is appreciably greater than the diameter of the game ball.

6. A foot-attachable game apparatus for tossing and receiving a game ball as in claim 1 further comprising first cushioning means covering the first wall inside the housing and second cushioning means attached to the retaining means and the first wall inside the housing for cushioning the impact of a game ball received in the housing.

7. A foot-attachable game apparatus for tossing and receiving a game ball as in claim 6 wherein the first and second cushioning means are one integral piece.

8. A foot-attachable game apparatus for tossing and receiving a game ball as in claim 6 wherein the first cushioning means comprises a non-resilient foam pad and the second cushioning means comprises a netting.

9. A foot-attachable game apparatus for tossing and receiving a game ball as in claim 6 further including a recess in the first cushioning means near the scoop means for cradling a game ball between the scoop means and the edge of the recess.

10. A foot-attachable game apparatus for tossing and receiving a game ball as in claim 1 wherein the ball retaining means comprises a third wall.

11. A foot-attachable game apparatus for tossing and receiving a game ball as in claim 1 further comprising a gap between the second wall and the second cushioning means.

* * * * *